US006723905B2

(12) United States Patent
Gillis

(10) Patent No.: US 6,723,905 B2
(45) Date of Patent: Apr. 20, 2004

(54) SPLIT-CLIP MUSICAL INSTRUMENT

(76) Inventor: Archie John Gillis, 1053 Hwy 105, Lexington, Nova Scotia (CA), B9A 1T1

( * ) Notice: Subject to any disclaimer, the term of this patent is extended or adjusted under 35 U.S.C. 154(b) by 0 days.

(21) Appl. No.: 10/076,239

(22) Filed: Feb. 15, 2002

(65) Prior Publication Data

US 2002/0112592 A1 Aug. 22, 2002

(51) Int. Cl.[7] ..... G10D 3/00
(52) U.S. Cl. ..... 84/318; 84/317
(58) Field of Search ..... 84/318, 317, 319, 84/320

(56) References Cited

U.S. PATENT DOCUMENTS

| | | | | | |
|---|---|---|---|---|---|
| 4,503,747 | A | * | 3/1985 | Labbe | 84/318 |
| 4,793,234 | A | * | 12/1988 | Geis | 84/318 |
| 4,926,732 | A | * | 5/1990 | Collins et al. | 84/318 |
| 5,101,706 | A | * | 4/1992 | Kilgore | 84/318 |
| 5,492,045 | A | * | 2/1996 | Roblee | 84/318 |
| 5,932,822 | A | * | 8/1999 | Bernstein | 84/314 N |

* cited by examiner

*Primary Examiner*—Kimberly Lockett
(74) *Attorney, Agent, or Firm*—Emch, Schaffer, Schaub & Porcello Co., L.P.A.

(57) ABSTRACT

An inventive stringed musical instrument comprising an independent string copoing device adapted to secure a string of a guitar or other fretted stringed musical instrument at selected fret position in order to quickly and easily vary the length of the string available for vibration, to change the pitch when the string is plucked or bowed.

The independent string copoing device describes clips and a clip placement installation area adapted to secure a clip style fixing device to a selected fret on the fretboard, the clips and clip insertion area so shaped as to complement each other for locking a string or plurity thereof to a pressed down or mechanically fingered position. The instrument may also include the use of a split-nut structure comprising a permanently divided nut, and a method for tuning the stringed instrument comprising tuning the instrument to a non-standard or altered configuration while utilizing a means of varying the length of independent strings with mechanical devices.

11 Claims, 5 Drawing Sheets

SPLIT-CLIP MUSICAL INSTRUMENT

BACKGROUND OF THE INVENTION

1. Field of the Invention

The present invention relates to a capo device for a stringed musical instrument having a series of strings extending along a fret or fingerboard with a series of frets (or unfretted), such as a guitar, lute, banjo, violin, and the like. Such an instrument is played by plucking or bowing the strings while using fingers to stop selected strings by holding them pressed down onto the fretboard, the string being "stopped" by the adjacent fret.

2. Description of Related Art

In guitars and other fretted musical instruments, one or more strings are stretched under tension across a sounding board or other main body of the instrument, which, upon the string vibrating, amplifies the sound of the vibrating string. One end of the string is anchored at one side of the main body or sounding board, the string is then strung across the sounding board, and along an elongated neck portion attached to the main body. The other end of the string is then anchored at the end of the neck away from the main body to tuning pegs or other devices, which permit adjustment of the string tension. At various set intervals along the neck portion are situated a plurality of frets, i.e., transverse ridges which underlie the plurality of strings, which frets are in turn resting upon a fretboard.

The strings do not touch the frets, even during vibration. The sound emitted from a plucked string is termed its pitch and is determined by the relationship of the tension of the string, its mass per unit length (which is a function of the string's diameter), and the length of the string available for vibration (effective length). The effective length of the string is the distance between a first anchor, called the bridge, attached at the head of the main body of the fretted stringed instrument, and a second anchor, called the string nut, attached at the far end of the neck. Many times, all the strings ride over a saddle, which is immediately adjacent to the bridge. The effective length in which case then starts at the saddle. At the neck far end is the second anchor, the string nut, over which all of the strings pass and contact immediately before they are attached to the tuning pegs.

On guitars or other fretted stringed musical instruments it is common for the musician to use his hand not plucking, bowing or striking the strings to press upon one or more strings of the instrument with one or more fingers to cause the string to engage the frets along the neck of the guitar or other musical instrument.

To easily change the pitch of the string, one merely shortens the string. To accomplish this, the player need only to press down on the string to cause it to engage one of the frets on the fretboard portion of the neck of the instrument. This procedure reduces the effective string length to the distance between the saddle and the fret. As a general rule, the 12th fret on a guitar is located one-half of the distance between the saddle and the string nut. Then, if the string is held at the 12th. fret the pitch doubles. A violinist or guitar player is constantly fingering the instrument as he plays it, using the fingers of the hand not plucking the strings (or drawing a bow across the strings) to change the pitch as called for by the musical score.

A prior invention by Eric S Leifeit for a positioner acting as a fixed fingering device was granted by the United States Patent Office on Jan. 17, 1989 and accorded U.S. Pat. No. 4,789,119 it concerned threaded inserts strategically placed in the fretboard, the inserts receiving machine screws, which cupped the string under its head. By screwing down the machine screw securely into the insert, the screw would secure the string over the fret. Such devices however, took some period of time for the player to unscrew the screws to a position above the height of the string, and then screw the screws down over the string. Such adjustment would require too much time to secure a string during a musical number. This device seemed also to be very visually unappealing and it seems, due to the location of the screws, that bending a string may not be accomplished at all locations.

A capo, sometimes referred to, as a "capotasto" is a device which can be used to hold strings independently of the fingers. Simple capo devices hold all the strings at once, usually against a particular fret, and change the basic key of the instrument. Others are known which can be used to press down and stop only selected strings, however these devices are very difficult for the performer to work around while playing.

Generally, capo devices do not allow different strings to be stopped at different locations. However, in U.S. Pat. No. 5,056,397, which issued on Oct. 15, 1991 to Leifheit, a kind of capo device, referred to as a "fingering device" is described for a guitar, in which a series of separate capo type elements are provided each with a bore by which the element is slideably mounted on one of the strings and is individually locatable to stop a string at a particular selected location. Each element has an undercut recess in its underside and can be individually held in position by having this recess engage one of the frets, which are made to protrude from the fretboard. The elements of the Leifheit device stop the strings directly, rather than hold the string against an adjacent fret, as is more usual with capo devices.

A perceived drawback of the Leifheit device is that the elements, when no longer in use, are simply pushed to the end of the strings near the string nut which terminates the vibrating portion of the strings near the head of the guitar. It seems likely that in this position the elements, although no longer attached to the fretboard, would still vibrate with and thus affect the vibration of the strings. It is also felt that when a string is to be bent as is very often done in performances, that the rectangular block would be moved perpendicular to the string and in some instances fall of the fret. Another downfall of this invention is that, to achieve the desired results, it seems the frets may need to be enlarged and modified, and many performers are very particular as to the size of their frets, as different fret sizes affect the playability of the instrument.

Another prior invention by Christopher George Sims and Jonathan Edward Sims was granted by the United States Patent Office on Aug. 14, 1998 and accorded U.S. Pat. No. 6,013,868 and it concerned a capo device for a stringed musical instrument in which each string passes through a bore in an element which is slidable on the string, each element being dimensioned so that when held against the fretboard, the element stops the string on which it is mounted at the adjacent fret. The elements and the fretboard have interacting magnetic means capable of holding each element against the fretboard at one of a number of selected positions during the playing of the instrument. It is felt that this device could easily be accidentally pulled off the fret during forceful playing of the instrument or the bending of the strings.

In common instrument usage, the "nut" of a stringed instrument is an insert piece of bone, plastic or the like, which fits at the end of the fingerboard and acts as a support upon which the instrument's strings are positioned. Current nuts are created in one piece. The problem with using only this form of nut is that open tunings or varying the pitches of open strings requires that the performer re-learn the notes on the fretboard, which is a timely task.

The Kubicki Factor bass has a divided nut portion for a low D tuning however it lacks the ability to create the more complicated open chord/pitch configurations.

Banjos have a short string located at the lower portion of the neck, usually from the 5th fret onward. This division however is made on the neck of the instrument and not the nut and therefore is quite different than a split-nut structure. A banjo would be classified as a split-neck structure. A split-nut instrument maintains a standard neck.

All instruments have what is known in the art as standard tunings. As an examples guitars are tuned EADGBE, basses EADG, mandolins GDAE etc. These standard tunings are sometimes altered for various effects; they are sometimes labeled as open tunings in which case they usually form an open chord (a chord, which is not fingered by the performer). A capo is often used to change an altered or standardly tuned guitar to a higher frequency grouping yet maintains the identical intervalic structure of the standard or open tuning.

Open or non-standard tunings require the performer to re-tune the instrument, which can be quite troublesome, then relearn the guitar neck for each alternate tuning, which is enormously time consuming. Some devices have been created to eliminate these problems. Fixed fingering devices, variable chord forming capos, etc., have been designed to eliminate this problem and also make open tunings possible without having to retune the instrument. It is obvious that these devices were created to eliminate the need for the retuning of the selected instrument. Current existing tuning methods include, an instruments standard tunings, and an instruments altered tuning. With any of these tunings, a standard capo may be used to raise the frequency of pitch yet maintain the identical intervallic structure in which the instrument is tuned. It is a fact that any device currently existing for a means of varying the length of an individual string rather than a collection of strings, has been designed for a standardly tuned instrument. To achieve alternate tunings, mechanical devices such as the fixed fingering devices or chord forming capos are used; the guitar however is not re-tuned as instruments with these capabilities can achieve open tunings by means of the added mechanical devices.

Thousands of guitarists from around the world, and encompassing virtually every style of music, use "open tunings" on their guitars. The standard tuning for a guitar is EADGBE, or intervalicly, perfect forth, perfect fourth, perfect fourth, perfect fourth, major third, perfect fourth. When open tunings are used, the guitar is re-tuned to a variety of notes and/or chords for various effects. Examples of some of these tunings are EG#BEG#E, DADGBE, DADGAD, DADF#AD, etc.

There are many benefits created by open tunings such as, open harmonics, open chords, drone notes, alternate (previously impossible) chord voicings, open note tapping, different counterpoint possibilities etc.

There is a problem however, which arises from all these tuning systems. As the typical guitarist generally learns the guitar fret-board and its notes in standard tuning, when the guitarist re-tunes or openly tunes the guitar, he or she must re-learn the entire guitar fret-board, each time they change to an alternate tuning. This is incredibly time consuming and very limiting to the guitarist. Due to the number of open-tunings available to the modem guitarist, this makes openly tuned songs very difficult and frustrating for many players of the instrument. If for example a guitarist wanted to learn or write a group of songs in the tunings of DADGAD, DGDGBD, and DADGBE, he/she would be required to learn the guitar neck in three different ways, which is extremely complicated and confusing.

With these facts in mind it is assumed that there is a need in the art for a guitar which can be configured for open or alternate tunings yet yield itself to easily accessible, previously studied, open chord and scale patterns, that are popular in today's and yesterdays guitar music, whether the music is classical, folk, rock, blues, jazz, etc.

Current tuning methods available do not enable a player to modify an instruments standard tuning and at the same time independently vary a string or strings vibrational length. Some capo's have been designed for forming chords or drop E positions however they lack the efficiencies of other key possibilities except when a standard capo is used in unison with the alternative capo.

A standard guitar is tuned EADGBE which intervalicly equals a perfect 4.sup.th, perfect 4.sup.th, perfect 4.sup.th, perfect 4.sup.th, major 3.sup.rd, perfect 4.sup.th. This tuning is unsymmetrical and makes mastering the guitar a very difficult task. Pianos, basses (including 5 and 6-string etc.), mandolins, ukuleles, violins, cellos etc., are all symmetrically tuned.

The question then arises that if these tuning systems are so efficient for other instruments, why not tune all the guitar strings in perfect 4.sup.th,s? The answer to this question is:

(1) Some musicians already have. Examples are Pat Metheny and Stanley Jordan; (well respected jazz guitarists). There are various other examples of performers who have found it beneficial to tune their instruments symmetrically, at least some of the time. It is felt that there are major benefits in scale, interval, and chord pattern recognition etc. To play a scale in one octave, one can achieve the identical pattern in other octaves, string groups or positions on the guitar neck.

(2) Perfectly symmetrical 4.sup.th tunings such as (EADGFC) used on the currently most popular manufactured guitar make open position chords very awkward to play. Perfect 4.sup.th,s do not lend themselves very well to open chord patterns. This is the primary reason for our standardly tuned guitar we find most popular today, (EADGBE). This standard tuning lends itself very efficiently to open chord patterns, popular in every form of guitar music from classical blues, jazz, rock etc.

The clipping feature may be used to create symmetrical tuning configurations on the guitar fretboard while maintaining standard (or a desired open tuning).

The related art includes;

U.S. Pat. No. 4,798,119

Fixed fingering device for fretted stringed musical instrument.

U.S. Pat. No. 5,056,397

Fixed fingering device for fretted stringed instruments.

U.S. Pat. No. 6,013,868

Capo device.

U.S. Pat. No. 5,623,110

Quick setting variable chord forming capo.

U.S. Pat. No. 4,926,732

Variable chord forming capostrato.

U.S. Pat. No. 4,593,595

Mechanical guitar chord maker.

U.S. Pat. No. 4,471,682

Automatic chording device for guitars and similar instruments.

U.S. Pat. No. 4,249,450

Guitar and chord playing attachment pivotally mounted there on.

U.S. Pat. No. 4,183,279

Variable chord forming capo.

U.S. Pat. No. 4,154,134

Chord playing attachment for stringed instruments.

In U.S. Pat. Nos. 4,798,119, 5,056,397 and 6,013,868 for example, the inventors anticipated the need for an instrument with string shortening devices, however neglected many features which are included in the "pinch-clip", such as the locking system used which will prevent the string from accidentally changing its pitch. It is felt that the devices used in U.S. Pat. Nos. 5,056,397 and 6,013,868 could easily, accidentally be released, if the strings were to be bent, even in the slightest, or if the performer, performed in a slightly vigorous style. There are many other inefficiencies within these instruments as well, which is why it is felt there is a need in the art for the "pinch-clip". The prior art fails to teach at least the advanced "split-nut" instrument, nonstandard tuning configurations utilizing means to vary the independent length of a string by such mechanical devices as pinch-clips, fixed fingering devices, variable chord forming capos.

SUMMARY OF THE INVENTION

The present invention seeks to provide a capo type device, which overcomes these drawbacks, and is also easier to use than the Leifheit device. The device of this invention is easy to engage and disengage with the fretboard, it stops the strings in the usual way by holding them against adjacent frets, which are conventional frets, and it provides a storage area for the elements when they are not in use where they cannot vibrate with the strings.

It has been determined that it would be useful to have a device which mechanically fingers one or more strings of a stringed instrument for a changed, but constant pitch, during a whole musical number or a portion of one while at the same time making the remainder of the instrument strings, including the mechanically fingered string, still available for further non-mechanical fingering by the musical player. It is to this invention that the subject patent is directed. It would also be useful if such a device could be placed or removed in a very short period of time, perhaps in less than a second or two.

The present invention seeks to create a new method of tuning where a stringed musical instrument utilizing a means to individually vary the length of an independent string is tuned to a non-standard tuning configuration for various innovative results.

The present invention seeks to provide a mechanical device for mechanically fingering a fretted stringed musical instrument.

The present invention seeks to provide a mechanical device so that various lengths of a stringed instrument string can be fixed for different pitches.

The present invention seeks to provide a clip device proximate every fret for every string of the instrument to provide complete pitch selection of strings of a fretted stringed instrument.

The present invention seeks to provide a mechanical device for varying string pitch of a fretted stringed instrument where the clipping device, when not being used, is out of the way of the vibrating strings and fingers of a player.

The present invention seeks to provide a new innovative tuning method where the tuning method comprises tuning the instrument to a non-standard configuration while utilizing a means of varying the length of independent strings with such mechanical devices as a pinch-clip, fixed fingering device, variable chord forming capo and the like to achieve tuning methods which can not be achieved with a standard capo, or developing a Split-nut instrument where a selection of open pitches are chosen and a tuning method is applied in which an intervallicially non-standard tuning configuration is achieved at all other portions of the instrument such as the fret positions not utilizing a nut division, to achieve the same tuning method possibilities, which can not be achieved with a standard one fret capo. As an example a guitar may achieve a desired result by adding an extra fret to the B and E strings near the head portion of the instrument, hereby creating a intervallic symmetry at all other portions of the instrument neck or fret locations.

The present invention seeks to provide a new innovative split-nut structure, which may be varied in numerous ways for desired results. This nut-structure being permanently divided on the instrument and may be used with the features of a Pinch-clip or other such devices to alter the new nut structure to a standard nut or desired configuration.

Other objects of the invention will in part be obvious and will in part appear hereinafter. The invention accordingly comprises the apparatus comprising the construction, combination of elements, arrangements of parts and methods of using which are exemplified in the following detailed disclosure, and the scope of the invention, which will be indicated in the claims.

According to an aspect of the present invention there is provided a string clip for holding at least one string of a stringed musical instrument to a fret position to selectively vary the vibrational length of the string, comprising a fixing portion adapted to be pushed into and held by a groove on the instrument neck; and a contact portion disposed such that, when the fixing portion is held in place by the groove, the contact portion contacts and holds the at least one string in a fret position to determine a vibrational length of the at least one string.

According to another aspect of the present invention there is provided a clip positioner adapted for attachment into a string side of an instrument neck adjacent individual frets and under strings for receiving at least one string clip as defined above for holding at least one string of a stringed musical instrument to a fret position, comprising a planar member adapted to span a width of the instrument neck; and a plurality of grooves formed in the planar member which, when the clip positioner is placed in the instrument neck, align with stings of the instrument.

According to yet another aspect of the present invention there is provided a fretboard having formed therein at least one clip positioner as defined above.

According to still another aspect of the present invention there is provided a stringed musical instrument having a fretboard as defined above.

The present invention relates to a device for the mechanical fingering of a fretted stringed musical instrument such as a guitar, violin, ukulele, and the like. Fingering is accomplished by the process of shortening one or more strings of the musical instrument to produce a pitch different than the usual unaltered frequency.

The devices which are the means to mechanically finger the instrument include clip style fixing devices and clip style fixing device receiving inserts set into the fretboard at a series of locations adjacent individual frets, (or attached to the frets on the fretboard of the stringed instrument neck), to hold the string down so that it will be fixedly held at the immediately adjacent fret. The clip is so situated on the fretboard that when it engages the string and holds it down, the string is not moved laterally from its previous unengaged position.

The insert or clip placement installation area is located just below the top surface of the fretboard. Preferably, there is one insert located behind every fret on the neck of the guitar or other stringed instrument, and preferably there will be the equivalent number of clip placement positioners located on the inserted piece of material, as there are strings on the musical instrument.

By means of the pinch-clips (or clip style fixing devices), a player may fixedly finger the musical instrument to change one or more string pitch and then just as easily un-pinch the clip with a thumb and finger to release the held string.

Benefits

With the described new innovations, musical possibilities will exist that prior to the described invention could not have been contemplated.

A great number of musical pieces are written and performed by guitars, in open tunings. Open tunings require the performer to re-tune the instrument, which can be quite troublesome and then relearn the entire guitar neck for each alternate tuning, which is enormously time consuming. With the clip feature innovation, the need for re-tuning the guitar to open chords can become a thing of the past. Re-learning the guitar neck for these popular or new configurations will no longer be necessary. Performing cover tunes or originals at live performances requiring openly tuned configurations will no longer be difficult or time consuming, and extra guitars will no longer be required at shows for the purpose of being openly tuned for quick change-ups.

New compositions utilizing new possibilities previously impossible to create on standardly tuned instruments such as the guitar will also now be available.

Benefits of the Invention Concerning Clipping Devices Used on a Standardly Configured (Tuned) Instrument;

The open chord feature can be designed to an individuals desired open tuning system. As an example there are musicians who may only use the tuning system DADGAD. For these musicians a guitar could be configured with DADGAD tuning, yet still have the ability to retain standard or symmetrical chord, scale, arpeggio patterns etc., at all locations of the guitar neck Open tunings are now possible, without learning or re-learning the entire guitar fret-board.

Drone notes (such as used in Celtic music) will now be possible at any selected note without re-tuning or relearning the guitar.

If a guitarist is performing a cover tune (another artists musical and lyrical composition), with an open tuning and has only one guitar at the performance (which he does not wish to re-tune, the song can now be played without hassle.

An enormous number of new guitar arrangements, positions, chordal voicing etc, will now be available for use in composition, solo playing or accompaniment etc.

Artists who have used open tunings in the past include, Led Zeppelin, Ani Difranco, Liona Boyd, James Taylor, Dave Matthews, Metallica etc., and the list is virtually endless. These artists' arrangements can now be performed without re-tuning or relearning the guitar.

Open chord harmonics will be possible. The chord shape can be formed over the open harmonics and sounded just as successfully as openly tuned guitar harmonics.

Beginners, children or adults may use this feature as an educational tool, to learn how each chord is supposed to sound, or for instantly developing melodies with a simple harmonic background.

Bending of the strings or vigorous guitar playing will be possible without putting the guitar out of tune or releasing the clipping devices, thanks to the pinch-clips locking capabilities.

Benefits of the Invention Concerning Split-Nut Features;

The split-nut feature maintains the look and feel of a standard guitar (or whatever instrument it is applied to) yet provides an alternative choice for permanently open string frequency configurations not found on existing instruments, without re-learning ones instrument neck (unless desired).

A split nut has the ability to have its intonation set perfectly for the string length and frequency of the desired nut structure.

A split-nut has many of the advantages of a pinch-clip, however they are found in a permanent structure.

Benefits of the invention concerning its method of use regarding non-standard or altered tunings.

(A) Benefits of the Invention Concerning Altered Tuning Configurations Applied to Stringed Musical Instruments Utilizing a Means of Varying Independent Length of an Instruments String(s)

For the musician who is comfortable or familiar with open tunings on stringed musical instruments the new tuning possibilities will greatly enhance their abilities for an extra variety of possibilities.

Lower register alternate or non-standard tuning such as DADGAD, DADF#AD, DADGBE etc. will now be possible to achieve by altering the standard pitch of the instrument.

(B) Benefits of the Invention Concerning Alternate Tuning Configurations Applied to Standardly Tuned Stringed Musical Instruments Utilizing a Means of Varying Independent Length of an Instruments String(s) While Utilizing the Use of a Slide Device.

The new tuning method opens up new possibilities for playing slide guitar. Currently when playing slide guitar the open frequencies must share the same intervallic structure as the notes or chords being formed when pressing the slide against the strings of the instrument. With the new tuning methods described herein many new possibilities exist for alternate open chords or frequencies other than those determined by the use of the slide. As an example it will now be possible to play a guitar with an open 135131-G shape chord spelled out on the open strings and an open E 151351 shape when the slide is used. Many other possibilities also exist however are too numerous to out line in their entirety.

(C) Benefits of the Invention Concerning Symmetrical Tuning Configurations Applied to Standardly Unsymmetrical Stringed Musical Instruments Utilizing a Means of Varying the Independent Length of an Instrument String(s)

This instrument can be tuned in fourths with complete symmetry, yet have the benefits of most open tuning chord voicings currently available to the modern guitarist.

Reading musical notation, becomes a much simpler process, due to the possibility of symmetry with this guitar type invention. Interval recognition from the staff to the guitar can be perceived more easily. As an example a perfect 5.sup.th shape will be identical everywhere on the neck.

To learn a guitar lick (short musical phrase), in one position, with a symmetrically tuned configuration, one can immediately transfer the pattern or shape to higher or lower positions, including other octave ranges or positions. This saves the guitarist or musician an enormous amount of practice time, and creates a much brooder musical ability.

For the beginning or novice musician, the improvements found with symmetrical configurations may not seem very relevant, due to the student's focus on simple open chords. For the intermediate to advanced musician however who wishes to learn as many scale patterns, chords, intervals etc. as one can, the improvements become very substantial. As an example, for a 1573 major seventh, chord pattern, and its inversions, on a standardly tuned guitar, there are twelve different fingering patterns. On an improved symmetrically configured Pinch-clip the same chords can be played with just four patterns.

DETAILED DESCRIPTION OF THE DRAWINGS

Figure 1:
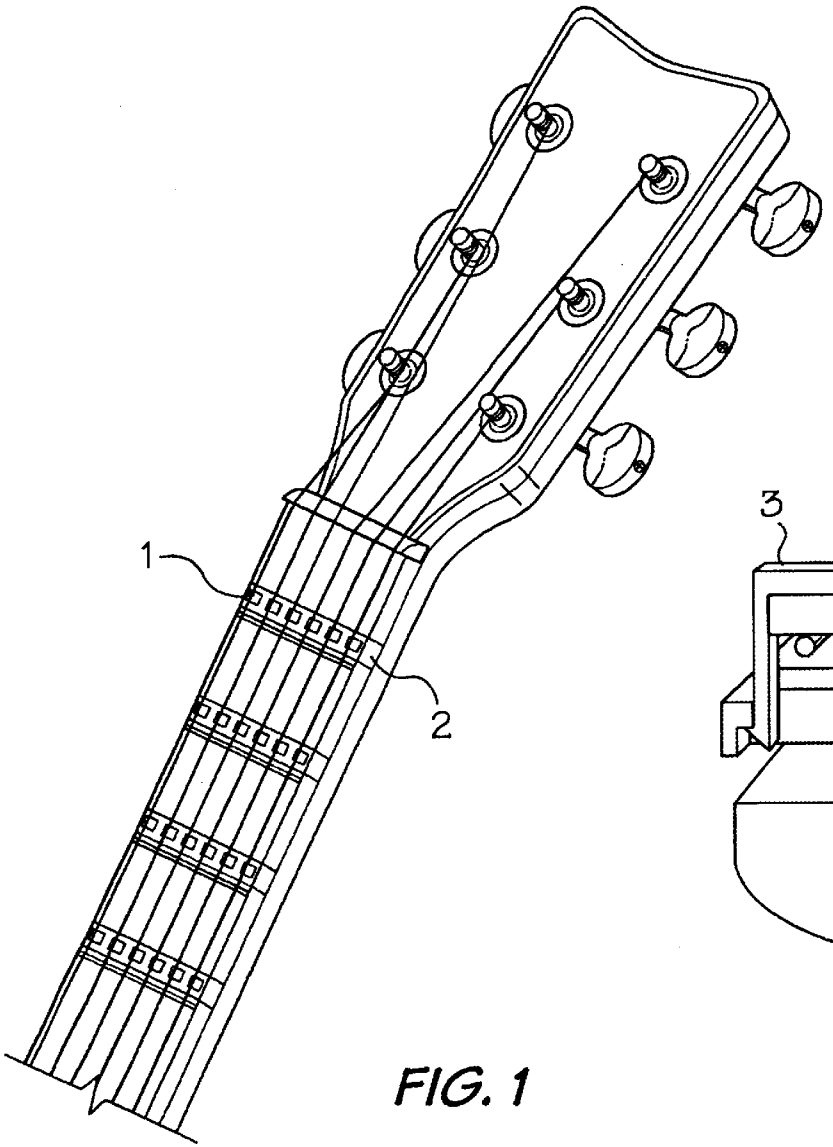
FIG. 1 is a perspective view of a neck end of a guitar with clip holes within clip placement positioners according to an embodiment of the present invention.

FIG. 1—(Guitar With Clip Holes)

This diagram describes the clip holes or clip insert area 1 as will be seen on the guitar and found within the clip placement positioners 2. The clip placement positioners 2 are small in nature and in no way should effect the guitars playability when functioning or not. Pearl inlay materials or means of reinforcement may be used as a material for the clip placement positioners 2 for securing the clips into place and to avoid placing wear on the fretboard. In some instances clip position inserts may be created that are removable, for insertion of a natural pearl inlay or for maintenance if ever required.

Figure 2:
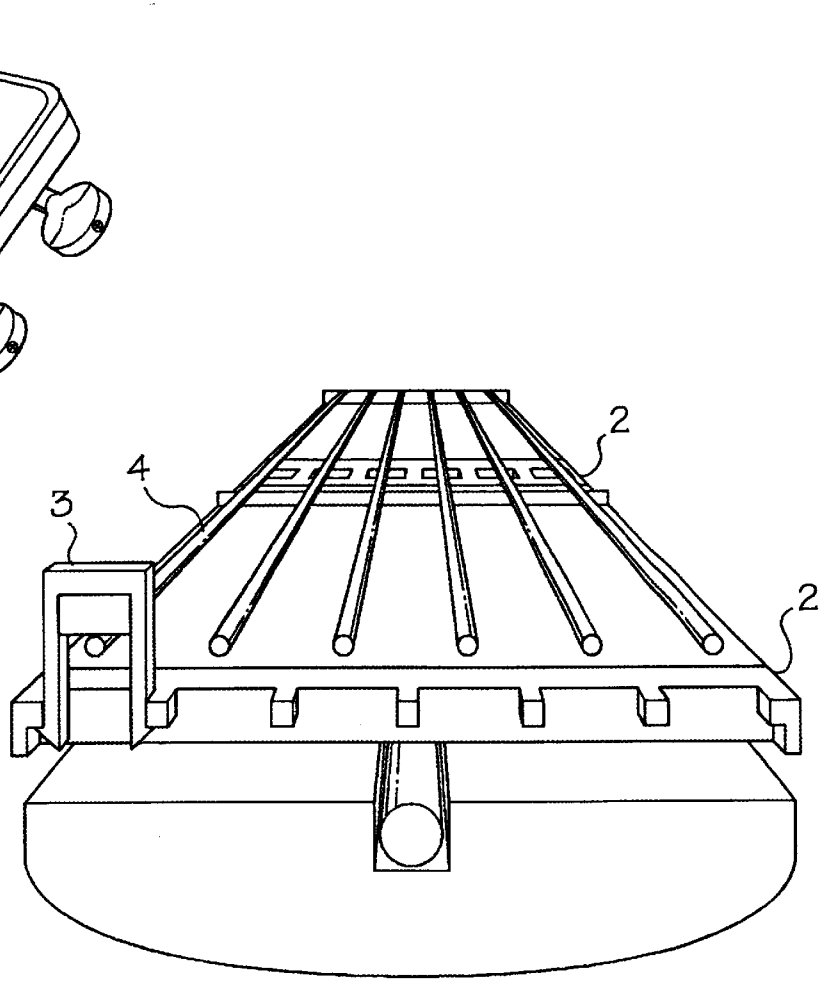
FIG. 2 is a view of a fretboard according to an embodiment of the present invention with a clip in place holding down a string.

FIG. 2—(Guitar With Clip in Place)

This diagram displays a fretboard with a clip 3 in place holding down a string 4. The inserted clip placement positioners 2 are viewed as if inside the guitar neck. It is shown that only the fretboard is modified. The neck remains as usual.

FIG. 3—(Clip)

This diagram shows a possible configuration of a clip. An arrow type 5 tip is used for easy insertion into the guitar neck and a flexible material 6 is to be used for an easy pinch and release process. A rubber like material 7 is used for the area that will be touching the guitar string.

Figure 4:
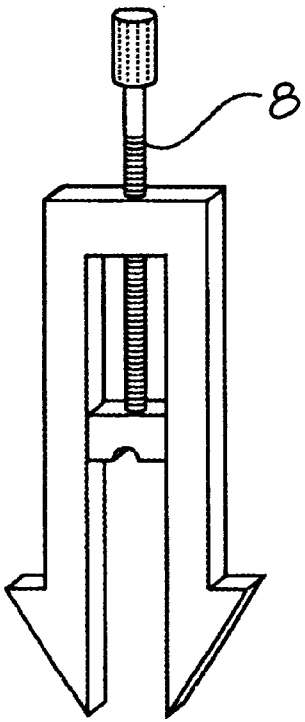
FIG. 4 is a perspective view of a clip having a screw type mechanism according to an embodiment of the present invention.
Figure 3:
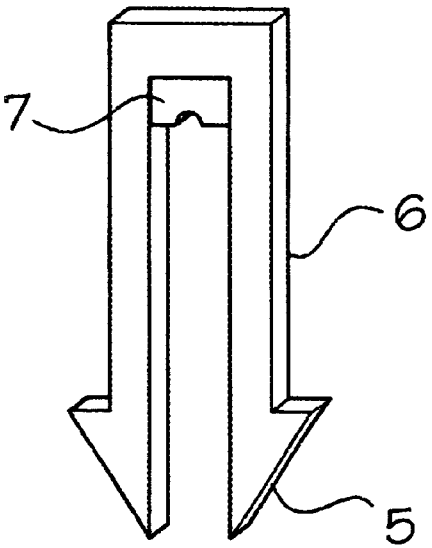
FIG. 3 is a perspective view of a clip according to an embodiment of the present invention.

FIG. 4—(Clip With Rotating Device)

This diagram shows an alternative clip configuration, which includes a rotating screw type mechanism 8 for varying the amount of pressure placed upon the string. This configuration may also make removal of the clip easier.

Figure 5:
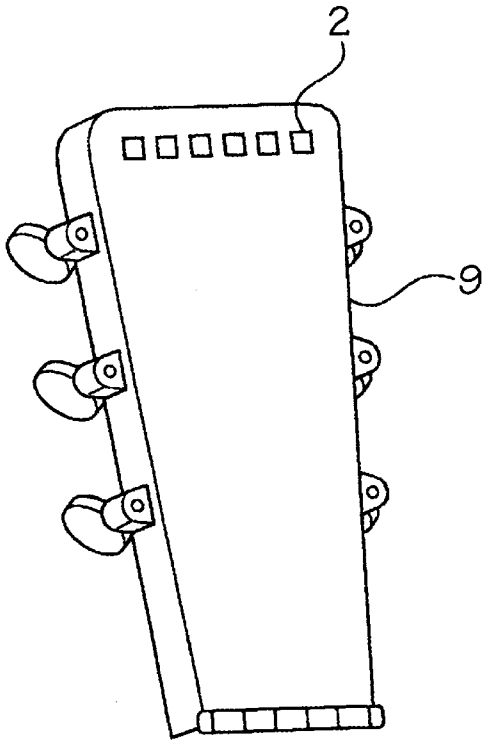
FIG. 5 is a perspective view of the neck end of a guitar having clips stored thereon according to an embodiment of the present invention.
Figure 8:
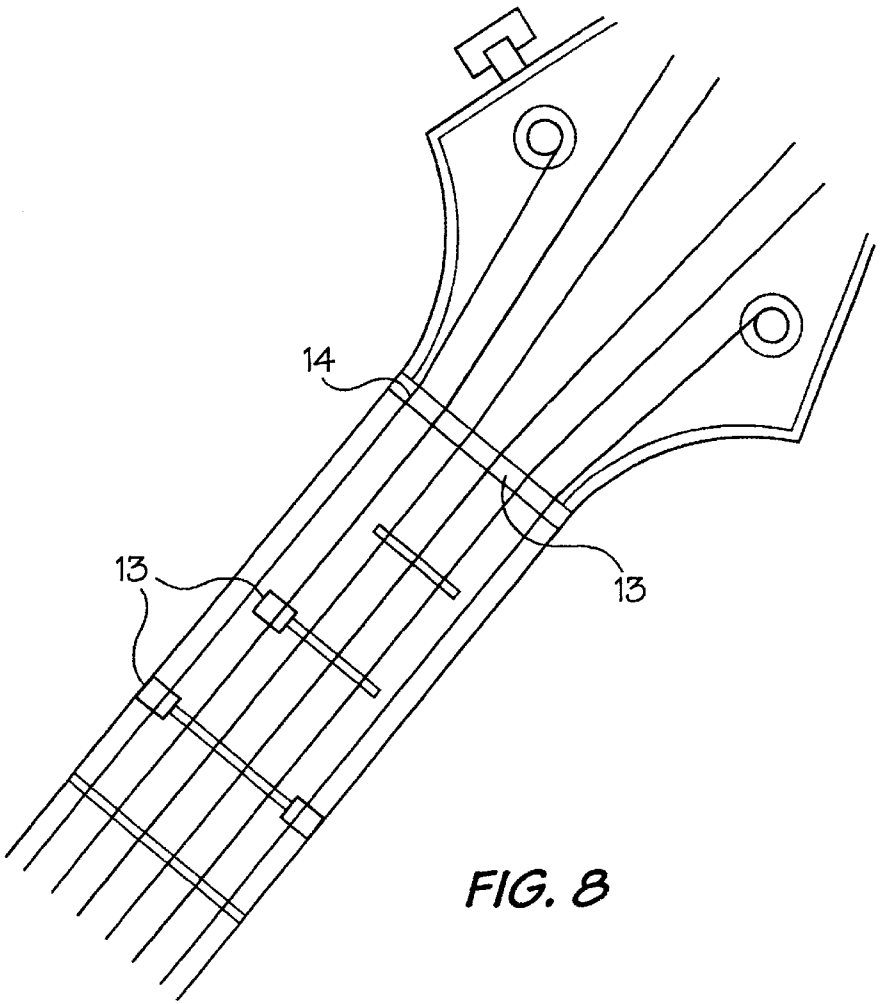
FIG. 8 is view of a neck end of a guitar having a split-nut according to an embodiment of the present invention.
Figure 7:
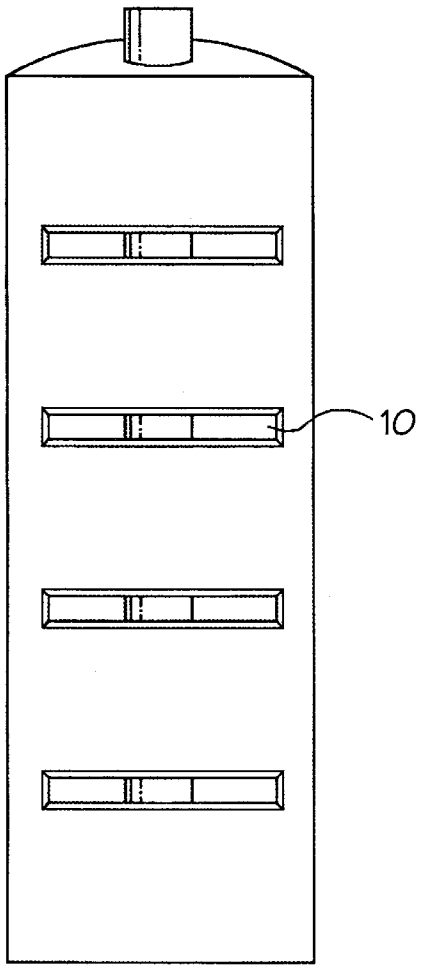
FIG. 7 is a perspective view of a neck having hollowed areas for extra clipping space according to an embodiment of the present invention.

FIG. 5—(Clip Storage Position)

This diagram shows a possible position for storage of the clips when not in use. A clip placement positioner or clip grooves 2 will be applied to the alternate location of the instrument such as the headstock 9.

Figure 6:
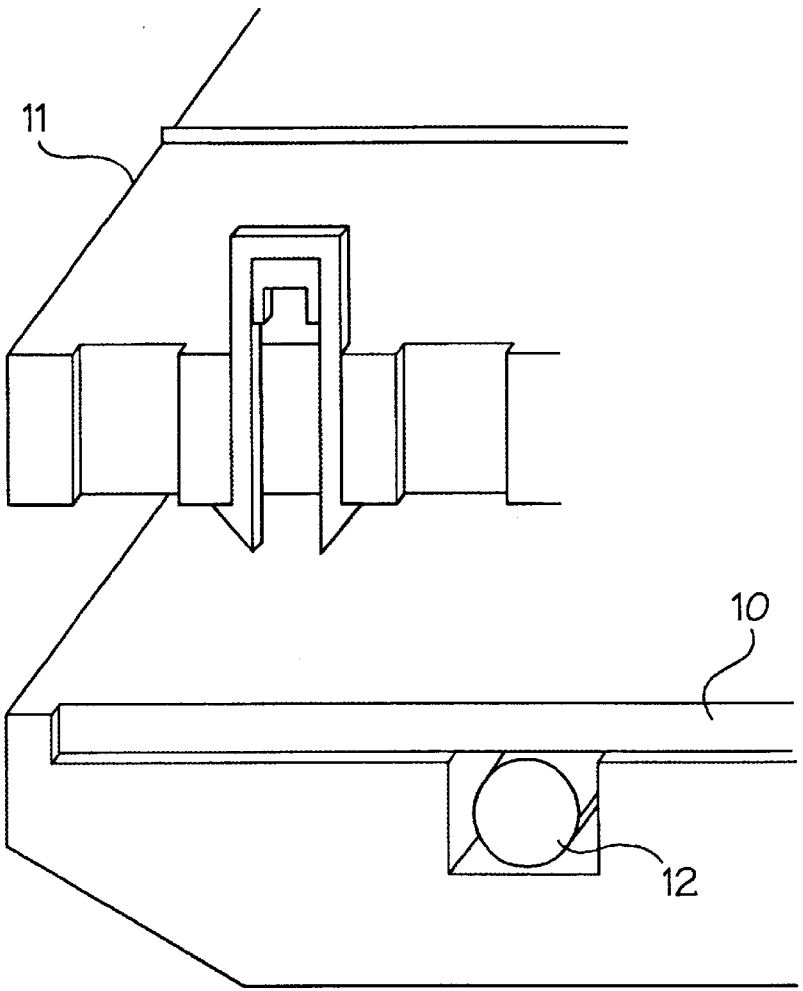
FIG. 6 is a perspective view of neck end of an instrument having a clip placed thereon according to an embodiment of the present invention.

FIG. 6—(Clip Which Utilizes Neck Space)

This diagram displays an alternative means for the clip position to be created utilizing any extra neck space available. There are grooves cut into the instrument neck 10 below the fretboard 11 and above the truss rod 12.

FIG. 7—(Neck)

This diagram displays an alternative view of a neck (without attached fretboard) and the hollowed areas for extra clipping space 10.

FIG. 8—(Split-Nut)

This diagram shows one possible configuration for a divided or split-nut 13. The nut is now non-adjustably configured as an open G chord for easy pattern recognition, perfect intonation settings and the desired open strings. A string guide 14, which may be configured in a similar fashion to a standard nut, may be used to direct the strings toward their means of attachment at the headstock of the guitar.

Figure 9:
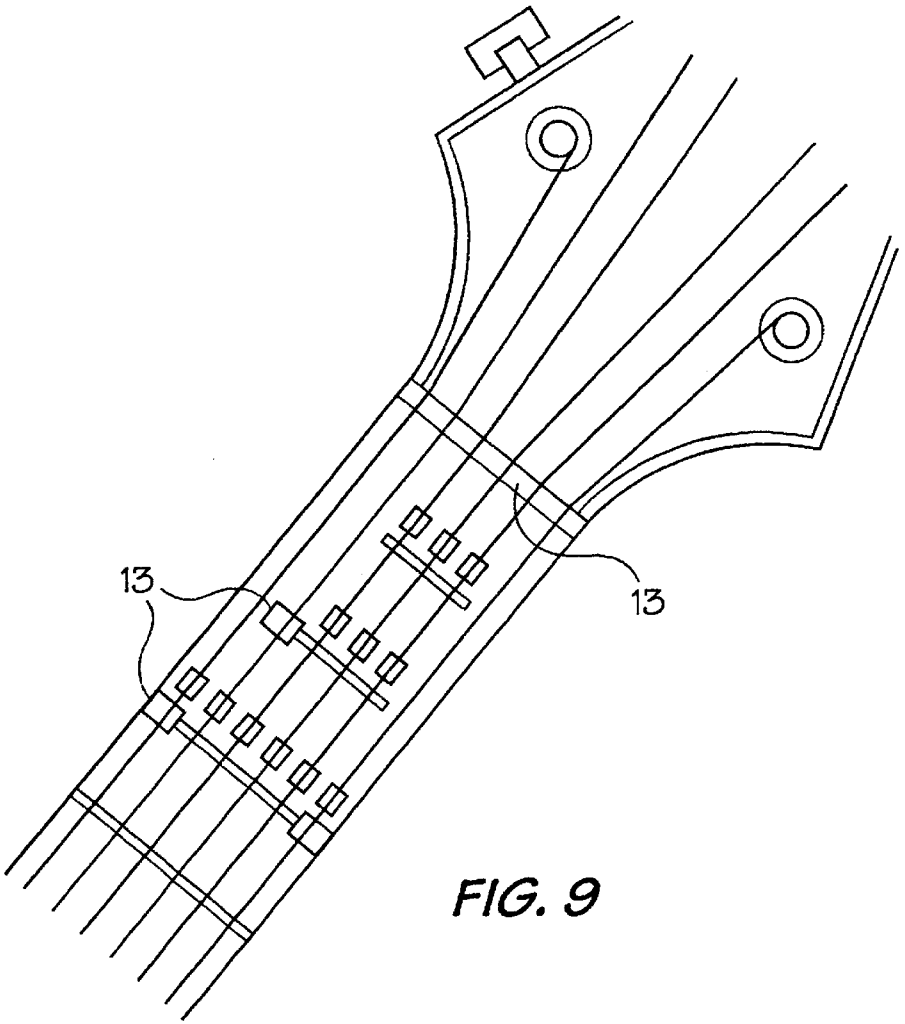
FIG. 9 is view of a neck end of a guitar having an alternative split-nut design according to an embodiment of the present invention.

FIG. 9—(Split-Clip)

This diagram shows a pinch-clip guitar, which utilized a split-nut feature 13 create a split-clip musical instrument.

Figure 10:
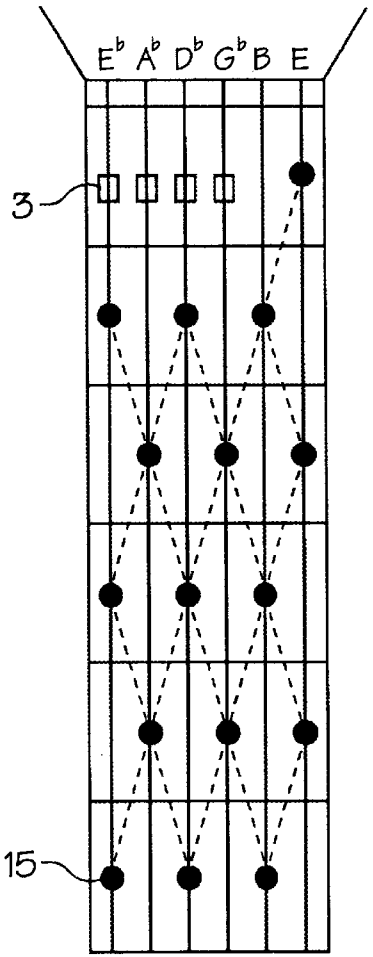
FIG. 10 is an illustration of a symmetrically tuned-pinch clip according to an embodiment of the present invention.

FIG. 10—(Whole-Tone Scale)

This diagram shows a symmetrically tuned pinch-clip. In this situation the strings will be tuned E flat, D flat, G flat, B and E. By utilizing clips 3 to press the strings against the first fret of the top four strings of the instrument we create a standard openly tuned guitar with perfect symmetry everywhere else on the fretboard. The whole-tone scale 15 is used to display this symmetry.

DETAILED DESCRIPTION OF A PREFERRED EMBODIMENT

The Pinch-clip has extremely distinguishable and useful innovative features. It may be looked upon as an improvement on an instrument such as the guitar or could fall into a separate instrument category, depending on the design of the instrument the innovative features are applied to.

The use of clips for open tunings is the main distinguishing feature of this instrument. Hollow or semi-hollow grooves are placed below the center of each fret and string. These grooves or clip insert positions provide an area for the clips to attach and push down the strings for open tuning or drone notes.

The clips themselves may be made from wood, metal or virtually any material, however the area that is touching the guitar string will be made from a material such as but not limited to rubber. The reason for this is to prevent ringing, buzzing or unwanted noise from the guitar. The rubber area or insert may include an indentation for additional string support and may be exacting to the gadge of the string used. The clips or fixing devices will be designed to fit over the string sizes of a performers choice and to fit perfectly with his/her desired fret size and height.

In some instances a rotating screw type mechanism (or plurality of) to adjust the desired pressure placed upon each string to be held down may be used. The screw end of this mechanism will, in the preferred embodiment, be made of a rubber like substance, to prevent unwanted noise. This rubber area may also include an indentation for additional string support or a plurality of indentations when a plurality of strings are held down with an individual clip.

Each clip will have a location for storage that is easily accessible on the guitar when not being used. This location could look similar to a clip fret location except its only purpose will be for storage of the clips. The clips are designed to be flexible and can be made from various materials such as plastic or metal and the like, so that they can be squeezed together for the locking and unlocking of a clip into its desired fret location.

The clips will have protruding lips which may be found in the form of arrow type tips so they can easily be pushed into place with little effort, and precise measurements will be made for any guitar utilizing the clip feature clips, without the adjustable screw type mechanism.

The term pinch in the title of this instrument refers to the unlocking of a clip after use.

The clips are easily pushed into the guitar neck or fretboard and pinched to release. This feature allows the clips to easily lock into place for security when string bending and for forceful playing of the instrument. It also allows for quick and easy removal after the clip is no longer required. The clip is then locked into a clip storage location, located at an alternative location on the instrument.

A very strong benefit of the clips is that they will be created very small so that the musician's fingers can easily maneuver around them. All frets on all the strings will still be accessible to the musician, except for the frets prior to a clip on an individual string (which notes would not be used anyway). As an example an open G chord could be clipped into place in frets 3 of the low E and high E strings, and fret 2 of the A string, yet maintain accessibility to frets 1, 2 and 3 of the D, G, and B strings, and fret 3 of the A string, among all the other notes.

The innovative Split-nut feature is accomplished by dividing a stringed musical instrument's nut into various configurations. A split-nut is a means of permanently varying the length of different strings on an instrument. Most instruments, prior to fingering by the musician, have string lengths that are for the most part nearly identical in length (except for minute adjustments in intonation). The split-nut feature maintains the look and feel of a standard guitar (or whatever instrument it is applied to) yet provides an alternative choice for permanently open string configurations not found on existing instruments, without re-leaning ones instrument neck (unless desired). The task of dividing the nut is quite simple. The piece of material used to create a nut is simply cut or divided and permanently fixed to the desired configuration of nut-structure. The Pinch-clip may include the use a Split-nut or vice-versa to create the Split-clip musical instrument however, both features may be implemented independently for innovative and useful results.

In the preferred embodiment the Split-clip, Split-nut and Pinch-clip will have available for use, all currently existing standard tuning methods for the instrument which they are applied, however in addition to these they will also have new innovative tuning methods or innovative methods of using the new instruments involving retuning a standard instrument to a non-standard configuration while utilizing a means of varying the length of independent strings with such mechanical devices as a pinch-clip, fixed fingering device, variable chord forming capo and the like to achieve tuning methods which can not be achieved with a standard capo, or developing a Split-nut instrument where a selection of open pitches are chosen and a tuning system is applied in which an intervallicially non-standard tuning configuration is achieved at all other portions of the instrument such as the fret positions not utilizing a nut division, to achieve the same tuning method possibilities, which can not be achieved with a standard one fret capo. As an example a guitar may achieve a desired result by adding an extra fret to the B and E strings near the head portion of the instrument, hereby creating a intervallic symmetry at all other portions of the instrument neck or fret locations.

I claim:

1. A string clip for holding at least one string of a stringed musical instrument to a fret position to selectively vary the vibrational length of the string comprising:

a fixing portion adapted to be pushed into and held by a groove on the instrument neck; and a contact portion disposed such that, when the fixing portion is held in place by the groove, the contact portion contacts and holds the at least one string in a fret position to determine a vibrational length of the at least one string.

2. A string clip in accordance with claim 1, wherein the string clip is u-shaped;

wherein said fixing portion comprises two flexible arms each having a half arrow portion at a distal end thereof; and wherein said contact portion is located inside a closed end of the u-shaped clip.

3. A string clip in accordance with claim 1, wherein said contact portion made of rubber.

4. A string clip in accordance with claim 1 wherein said contact portion has attached thereto a screw mechanism which allows for displacement of said contact portion in directions toward and away from a string.

5. A string clip in accordance with claim 1 wherein the contact portion comprises at least one concave portion adapted to receive at least one string.

6. A string clip in accordance with claim 1 wherein the fixing portion is made of a material selected from the group consisting of metal and plastic.

7. A clip positioner adapted for attachment into a string side of an instrument neck adjacent individual frets and under strings for receiving at least one string clip as defined in claim 1 for holding at least one string of a stringed musical instrument to a fret position, comprising:

a planar member adapted to span a width of the instrument neck; and a plurality of grooves formed in the planar member, disposed such that when the clip positioner is placed in the instrument neck, the clip positioner aligns with the at least one string of the instrument.

8. A clip positioner in accordance with claim 7 wherein the clip positioner is composed of a material selected from the group consisting of plastic, pearl and metal.

9. A fretboard having formed therein at least one clip positioner as defined in claim 7.

10. A fretboard in accordance with claim 9 wherein said fretboard further comprises a plurality of grooves formed therein adapted to receive and hold a plurality of the string clips.

11. A stringed musical instrument having a fretboard as defined in claim 9.

* * * * *